US006077203A

United States Patent [19]

Lay

[11] Patent Number: 6,077,203

[45] Date of Patent: Jun. 20, 2000

[54] FOOTCRADLE EXERCISE APPARATUS AND FOOTREST

[76] Inventor: Kenneth G. Lay, P.O. Box 800, Edgartown, Mass. 02539

[21] Appl. No.: 09/161,025

[22] Filed: Sep. 25, 1998

Related U.S. Application Data

[60] Provisional application No. 60/060,193, Sep. 27, 1997.

[51] Int. Cl.[7] ..... A63B 23/00

[52] U.S. Cl. ..... 482/79; 482/80

[58] Field of Search ..... 482/79, 80

[56] References Cited

U.S. PATENT DOCUMENTS 4,813,666 3/1989 Costilow et al. ..... 482/80

4,951,938 8/1990 Smith ..... 482/80

5,135,450 8/1992 Smith ..... 482/80

5,411,456 5/1995 Lay ..... 482/79

*Primary Examiner*—Glenn E. Richman

*Attorney, Agent, or Firm*—Perkins, Smith & Cohen, LLP; Edwin H. Paul; Jerry Cohen

[57] ABSTRACT

A footcradle exercise apparatus and footrest having a base structure, a support assembly mounted for rotational movement with respect to the base structure, at least two support rollers mounted for rotational movement with respect to the support assembly, and a support member mounted with respect to said base structure. The two rollers are capable of supporting a base of a foot while the support member supports an Achilles tendon portion of a leg.

13 Claims, 2 Drawing Sheets

FOOTCRADLE EXERCISE APPARATUS AND FOOTREST

CROSS-REFERENCE TO RELATED APPLICATIONS

This application claims priority of U.S. provisional application Ser. No. 60/060,193 filed Sep. 26, 1997 entitled Footcradle Exercise Apparatus and Footrest by the present inventor.

BACKGROUND OF THE INVENTION

This invention relates generally to exercise equipment and, more particularly, to passive exercise equipment utilized for the lower extremities.

Footcradle exercise devices have been in use for many years. Unfortunately, past footcradle exercise devices, such as the type exemplified by U.S. Pat. Nos. 5,554,090; 5,087,036; 5,343,856; 4,561,649; 4,538,595; 5,165,363; and 5,498,222, have many problems associated therewith either in their ability to easily be used to strengthen calf muscles or in the fact that such devices, in many instances, come in contact with the arch of a foot for resistance which creates a problem that may ultimately lead to damage of the arch. For example, damage of the arch may occur because penetration with past devices is on the internal curvature of the arch.

Even further, footcradle devices of the past may be a source of hip-related injuries, especially in the elderly. Since hip fracture is the sixth leading cause of death in those over 65, the use of exercise equipment which may lead to such injury is not recommended. Studies have shown that hip joint fractures generally occur in two ways: one being an individual's loss of balance, and therefore a fracture of the hip upon impact; and another, more current view with regard to hip fracture, being that the fracture occurs in the bridge between the femur and the ball-and-socket hip joint due to a rotational torque. This generally takes place when an older person rises from a seated position to a standing position and occurs as a result of a lack of mobility of the hip joint and rigidity of the bridge between the ball and the femur. Therefore, it is torque which institutes a hairline fracture, and the pain causes a person to fall. It is, therefore, quite evident that the need for hip joint mobility is vital, especially for the elderly, and even equally important for the young. For example, the difference between a winning gymnast and a successful dancer is clearly dependent on a freely mobile ball-and-socket hip joint.

Presently, physical therapists have provided information that shows that a large number of knee injuries are also symptomatic of inflexible hip joints. Even further, ergonomics professionals relate the number of chronic back pain problems to seated office workers where one sits for an extended period of time and then has difficulty standing up, generally due to hip joint immobility. A prior patent, U.S. Pat. No. 5,411,456, issued to the present inventor entitled Footcradle Exercise Apparatus, has been somewhat effective as a passive exercise apparatus, especially for the lower extremities. However, there still exists a need for a footcradle-type exercise apparatus which overcomes many of the drawbacks associated with prior passive exercise equipment.

It is, therefore, an object of this invention to provide a footcradle exercise apparatus which is capable of strengthening calf muscles.

It is another object of this invention to provide a footcradle exercise apparatus and footrest which ultimately provides for a greater range of ankle, knee and hip joint mobility in all linear, lateral and rotational aspects.

It is still a further object of this invention to provide a footcradle exercise apparatus and footrest which eliminates stresses to hip joints as well as increases calf muscle, ankle and knee strength as well as hip mobility.

SUMMARY OF THE INVENTION

The objects set forth above, as well as further and other objects and advantages of the present invention, are achieved by the embodiments of the invention described hereinbelow.

The present invention incorporates a tubular adjustable frame or base structure, which includes therein a dual or plural roller support rotational or pivotal about an axis midway between a pair of individual rollers, also rotational about their own axes. In addition, the rotational dual roller support, as well as the individual rollers, have means associated therewith to control or retard their rotation. Even further, the individual rollers are adjustable with respect to one another, and the entire dual roller support is adjustable with respect to the tubular frame or base structure.

The present invention also includes a forward adjustable bracing mechanism such that the footcradle exercise apparatus can be made immobile by bracing it against the wall or the front plate of an office desk. An adjustable anchoring mechanism is associated with the rear of the base structure such that the footcradle can be anchored to a seat or a couch base, and therefore prevent its unwanted forward or backward movement.

During use, the forward dual rollers are utilized in conjunction with the foot by capturing the ball of the foot thereon without applying the undesirable internal pressure or penetration to the curvature of the arch while the rearward support member is utilized in conjunction with the Achilles tendon.

For a better understanding of the present invention, together with other and further objects thereof, reference is made to the accompanying drawings and detailed descriptions, and its scope will be pointed out in the appended claims.

DETAILED DESCRIPTION OF A PREFERRED EMBODIMENTS

Figure 1:
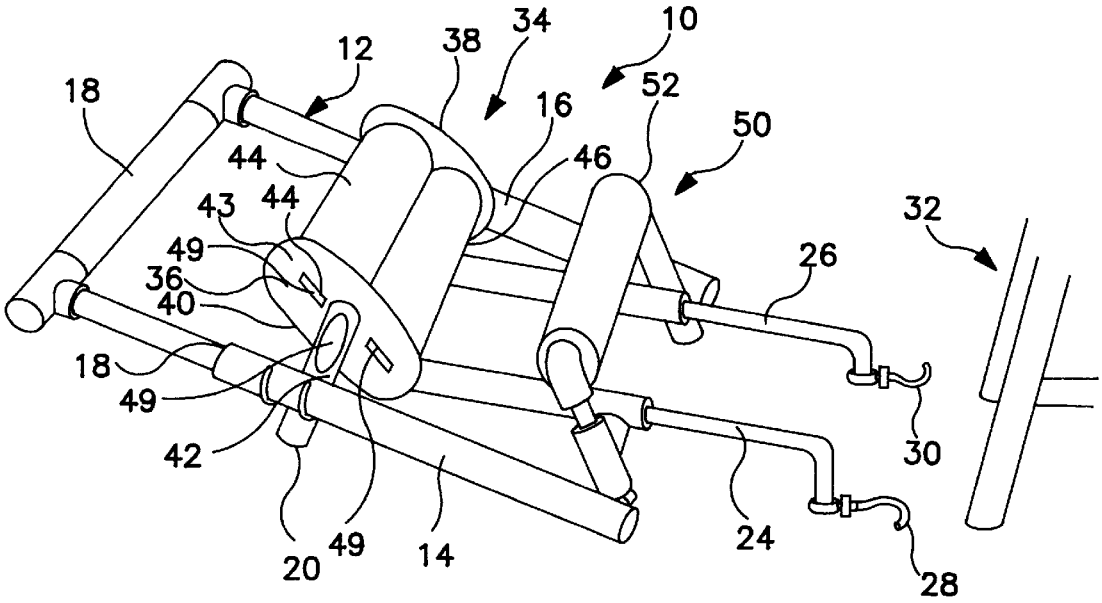
FIG. 1 is a pictorial representation of the footcradle exercise apparatus and footrest of the present invention.

Reference is now made so FIG. 1 of the drawings, which pictorially represents the footcradle exercise apparatus and footrest 10, hereinafter also referred to as footcradle 10. Footcradle 10 is preferably made of a tubular, frame-like configuration of any suitable light-weight, sturdy material, such as high-impact plastics or aluminum, having a U-shaped base structure 12. Base structure 12 includes a pair of tubular members 14 and 16, which have inserted at their forward ends a U-shaped bracing mechanism 18. Bracing mechanism 18 is adjustably mounted within the base structure 12 for slideable movement with respect to tubular members 14 and 16. The forward bracing mechanism 18 is utilized to make the footcradle 10 immobile by bracing footcradle 10 against a wall or front plate of an office desk or the like. Stop mechanisms (not shown) are associated with the bracing mechanism 18 so as to fixedly adjust the relationship between the bracing mechanism 18 and the tubular members 14 and 16. In addition, a pair of upstanding elements 20 are associated with tubular members 14 and 16, respectively, so as to adjust the height of the footcradle 10 with respect to the ground or floor. The upstanding elements 20 may also be adjustable, if desired. A further anchoring mechanism 22, made up of a pair of extensions 24 and 26, is provided with respect to the tubular members 14 and 16 and include hooks 28 and 30. Hooks 28 and 30 are utilized to affix the footcradle 10 to a seat or a couch base or the like. A portion of a chair 32 is shown in FIG. 1 adjacent to footcradle 10. As a further embodiment, the hooks 28 and 30 may be replaced by modification of extensions 24 and 26 such that the ends of extensions 24 and 26 have protrusions thereon constructed to engage the rear legs of a chair or the like and prevent both the forward and rearward movement of footcradle 10 of this invention.

Still referring to FIG. 1 of the drawings, footcradle 10 incorporates therein a forward dual roller support or assembly 34, made of a pair of sid; elements 36 and 38, which are pivotally or rotationally secured by any suitable rod or pin 40 to upstanding elements 42. Elements 42 are secured to tubular members 14 and 16, respectively. This arrangement may vary in its construction within the scope of this invention, with its ultimate effect being to rotationally or pivotally secure the forward dual roller support or assembly 34 with respect to the base structure 12. In addition, dual roller support or assembly 34 is adjustably mounted to elements 42 via a conventional slot/locking pin arrangement 43.

Interposed between the side elements 36 and 38 are a pair of support members or rollers 44 and 46 mounted for rotational movement with respect to the forward dual roller assembly 34. Rollers 44 and 46 are held in position by pins or rods 48 or any other such suitable elements capable of permitting the rotational motion of rollers 44 and 46 to take place with respect to the forward dual roller support or assembly 34. Furthermore, rollers 44 and 46 are adjustably mounted to side elements 36 and 38 via a conventional slot/locking pin arrangement 43 such that pins 48 move or can be locked within their respective slots for adjusting the distance between rollers 44 and 46. Rollers 44 and 46 are shown as two in number in FIG. 1 of the drawings, having a preferred linear distance of not more than 30 inches each, or, if desire, the dual rollers may be replaced with a set of four rollers (not shown), having a linear distance of no greater than 15 inches each. Conventional breaking mechanisms 49 are associated with roller assembly 34 and rollers 44 and 46 to control and/or retard the rotational movement of these components.

The rear end of footcradle 10 includes a single support or roller support 50, which is utilized to engage the Achilles tendon of a foot similar to the manner shown in U.S. Pat. No. 5,411,456. The roller support 50 includes either a rotational or stationary roller 52, which accommodates the Achilles tendon of a foot while the forward portion of the foot engages the forward dual roller support assembly 34 in a manner to be described in greater detail hereinbelow. All rollers contain a soft, flexible covering, which may also include nodules (not shown) which can be utilized to effectively massage the foot of a user.

Figure 2:
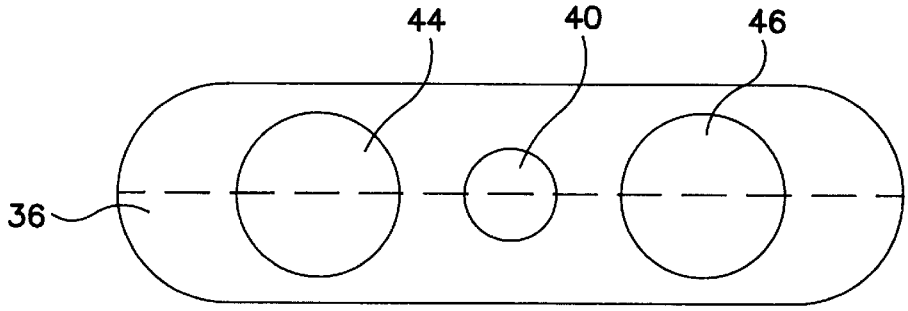
FIG. 2 is a schematic illustration of a co-linear roller assembly of the present invention.
Figure 3:
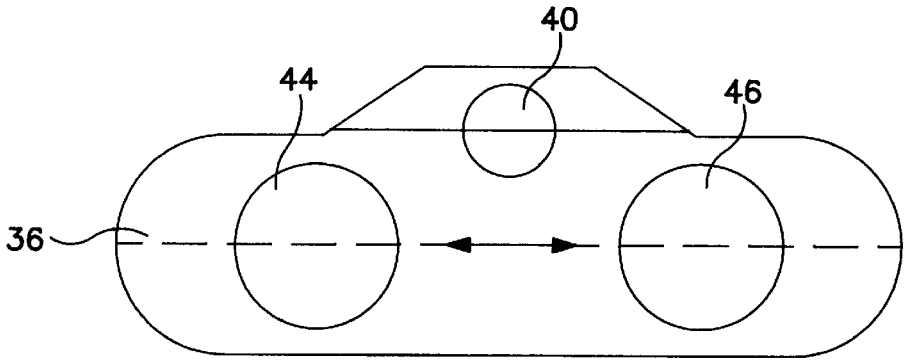
FIG. 3 is a schematic representation of a non-linear roller assembly of the present invention.
Figure 4A:
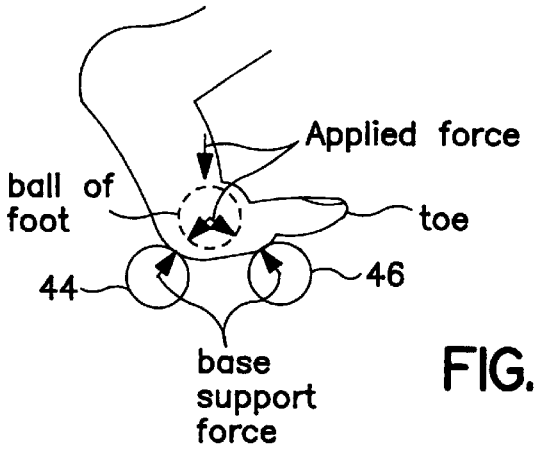
FIGS. 4A–4D are schematic representations of the relationships of the roller assembly with respect to the ball of a foot.
Figure 4B:
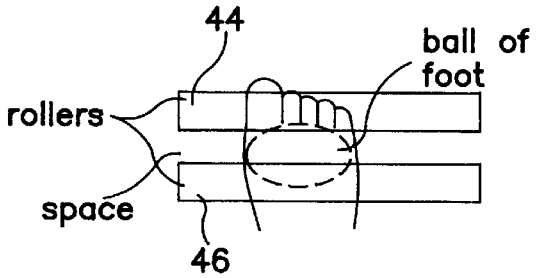
Figure 4C:
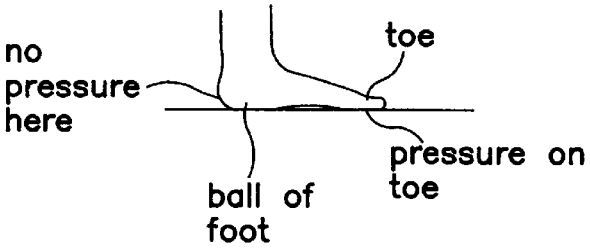
Figure 4D:
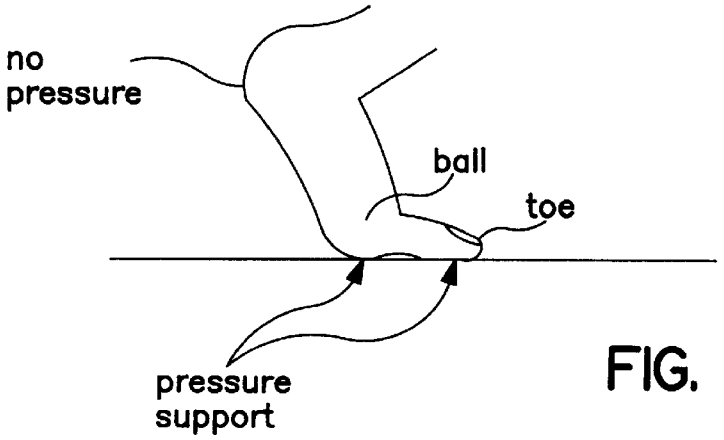

FIG. 2 illustrates schematically a co-linear arrangement of the forward dual roller support assembly 34, in which the rollers 44 and 46 are aligned with pin 40 of roller assembly 34. FIG. 3 illustrates a non-linear assembly wherein the rollers 44 and 46 are offset from the rod or pin 40 such as to form an eccentric roller arrangement.

Prior calf muscle exercise devices failed to take into consideration the complex geometry of the foot. The dual front roller design of the footcradle 10 of the present invention overcomes problems associated with past devices since it is focused on the metatarsophalangeal joint, otherwise known as the ball of the foot. In general, conventional calf exercise machines utilize a flat plane surface as the base to support the bottom of the foot while a user performs calf raises. As a consequence thereof, when the ball of the foot is moved forward, it rolls, changing the center of gravity of the foot and the line of the force created by this resistance mode. The present invention considers the shape of the ball of the foot (or metatarso-phalangeal joint) to be cylindrical instead of spherical, and thus, when an individual does a calf raise, the "cylinder" rolls forward, therefore changing the location of the applied force to a location forward of the ball of the foot, as shown in FIGS. 4A through 4D of the drawings. The dual roller design of the present invention utilizes two support members in the form of cylinders or rollers 44 and 46 to capture the cylindrical shape of the ball of the foot. Furthermore, these rollers 44 and 46 mechanically stabilize the ball of the foot while the calf raises are initiated. As a result, the applied force is contained within the ball of the foot, which increases the muscle activity and offers a mechanically stable base of support for that part of the anatomy.

A further aspect of the present invention is based on the refinement of the shape of the ball of the foot to one that is conical versus cylindrical. Since the joint at the big toe has a greater diameter than that of a small toe, the dual roller front support assembly 34 allows lateral rotation of the ball of the foot, as the knees are moved laterally both medially and distally. Thus, the dual roller support assembly 34 eliminates any resistance given that range of motion, an aspect not generally addressed in prior art designs. This is of great importance in the present invention since unrestricted lateral knee movement will cause the hip joint to rotate in the socket. As a result of such movement, the hips will gain a greater range of motion.

An illustration of why the hip joint locks up can be seen when seated, where there is virtually no vertical lift of the heal, and therefore the hip joint loses range of motion in a linear rotation. If there was a conscientious effort to lift the heal above the ground, the movement would start at 0 degrees and go to approximately 45 degrees above the floor surface. However, effectively one could never lower his or her heal below 0 degrees of the horizontal plane of the floor. Again, as the heal lifts up, the weight is transferred forward to the toes, which creates tension on the leg and foot to maintain the lift, because that position is dependent on friction. Consequently, a further benefit of the forward dual roller support assembly 34 of the footcradle 10 of the present invention is that the calf raises can be performed comfortably at any angle with respect to the floor, causing effective calf muscle activity at the full range of ankle flexion and extension (approximately ±60 degrees from the horizontal). In addition, the footcradle 10 of the present invention is of extreme value as a footrest to office workers and to sedentary individuals, and most certainly the elderly, in addition to being useful as a calf exercise machine.

The footcradle 10 of the present and its unique design are important for calf muscle exercises where more efficient muscle activity will be accomplished. More specifically, the role that the metatarsophalangeal joint plays as a movement of force with respect to load-bearing and movement potential of the ankle, knee and hip joint is further understood, thus developing a cause-and-effect relationship with regard to chronic lower back pain and hip anomalies.

As pointed out hereinabove, the footcradle 10 of the present invention also incorporates a forward bracing mechanism 18 adjustably associated with base 12 such that the footcradle 10 can be made immobile by bracing it against a wall or the front plate of a desk, while a second adjustable anchoring mechanism 22 is utilized with footcradle 10 to anchor the footcradle to a seat or chair 32 or couch base such that it prevents forward or backward movement of the footcradle 10. In addition to the above-described anchoring of footcradle 10, it should be understood that the present invention is also capable of multiple adjustability by the use of bungi-chord-type resistance members, as with prior devices. In addition, it is further desirable for the rollers and forward dual roller support assembly of the present invention to be free-wheeling, that is, fully rotational, or, if desired, the free-wheeling may be controlled with a mechanism 49.

Furthermore, when a person is forced to "hold" one leg in a fixed position as well as on a frictional surface, one's legs become fixated, and the hip, knee and ankle joints become stiff. This, therefore, affects t-he freedom of movement of such joints. Consequently, it is also important that the present invention incorporates therein the roller support 50 and roller 52, which engages the Achilles tendon, as in U.S. Pat. No. 5,411,456. Given this arrangement, the metatarsophalangeal joint will be geometrically and mechanically supported via the forward dual roller support assembly 34 of the present invention.

Utilization of the present invention permits the user to rest one's legs comfortably without tension while providing the user with a virtually limitless range of movement for the feet, ankles, knees and hip, given linear, lateral and rotational aspects. In addition, it should be understood that it is preferable for the rollers 44, 46 and 52 to be free-wheeling, although under certain circumstances controlled by mechanism 49 to prevent such movement. Preferably, however, the rollers are individually free-wheeling about their respective individual axes, and the forward support rollers are also free-wheeling about a center axis midway between each other. In addition, the forward dual roller support assembly 34 can be locked in a pre-selected, angular relationship with respect to the base structure 12.

Although the present invention has been described with respect to various embodiments, it should be further realized that this invention is also capable of a wide variety of further and other embodiments within the spirits and scope of the appended claims.

What is claimed is:

1. A footcradle exercise apparatus and footrest comprising:

a base structure;

a support assembly, horizontally arranged to accept the base of a foot, said support assembly rotationally mounted with respect to said base structure;

said support assembly including at least two cylindrical support members mounted horizontally above said base structure; and another support member mounted with respect to said base structure;

wherein said two cylindrical support members are constructed for supporting a base of a foot while said another support member supports an Achilles tendon portion of a leg.

2. The footcradle exercise apparatus and footrest as defined in claim 1 wherein said base structure further comprises at one end thereof an adjustably mounted bracing mechanism.

3. The footcradle exercise apparatus and footrest as defined in claim 2 wherein said base structure further comprises at another end thereof an adjustably mounted anchoring member.

4. The footcradle exercise apparatus and footrest as defined in claim 1 wherein said support assembly comprises a pair of spaced apart side elements rotationally supported with respect to said base structure and said support members each comprise of a roller interposed between said side members.

5. The footcradle exercise apparatus and footrest as defined in claim 4 wherein said rollers are adjustably mounted with respect to each other.

6. The footcradle exercise apparatus and footrest as defined in claim 5 wherein said support assembly further includes means operably connected thereto for controlling the rotational movement thereof with respect to said base structure.

7. The footcradle exercise apparatus and footrest as defined in claim 6 wherein each of said rollers include means operably connected thereto for controlling the rotational movement thereof with respect to said support assembly.

8. The footcradle exercise apparatus and footrest as defined in claim 7 wherein said base member comprises a tubular construction.

9. The footcradle exercise apparatus and footrest as defined in claim 8 wherein said base structure further comprises at one end thereof an adjustably mounted bracing mechanism.

10. The footcradle exercise apparatus and footrest as defined in claim 9 wherein said base structure comprises a pair of tubular members and said bracing mechanism is adjustably mounted thereto.

11. The footcradle exercise apparatus and footrest as defined in claim 10 wherein said base structure further comprises at another end thereof an adjustable anchoring member.

12. The footcradle exercise apparatus and footrest as defined in claim 4 wherein said spaced apart side elements are rotationally supported with respect to said base structure by a rod-like element and wherein said rollers and said rod-like element are co-linear with respect to each other.

13. The footcradle exercise apparatus and footrest as defined in claim 1 wherein said base member comprises a tubular construction.

* * * * *